US011358847B2

(12) United States Patent
Drocco et al.

(10) Patent No.: US 11,358,847 B2
(45) Date of Patent: Jun. 14, 2022

(54) MACHINE FOR REMOVING A LID FROM A CONTAINER AND THE RELATED PLANT

(71) Applicant: COMEC S.r.l., Grinzane Cavour (IT)

(72) Inventors: Luca Drocco, Alba (IT); Mario Drocco, Alba (IT)

(73) Assignee: COMEC S.r.l.

( * ) Notice: Subject to any disclaimer, the term of this patent is extended or adjusted under 35 U.S.C. 154(b) by 241 days.

(21) Appl. No.: 16/619,255

(22) PCT Filed: Jun. 5, 2018

(86) PCT No.: PCT/IB2018/054002
§ 371 (c)(1),
(2) Date: Dec. 4, 2019

(87) PCT Pub. No.: WO2018/224952
PCT Pub. Date: Dec. 13, 2018

(65) Prior Publication Data

US 2020/0095106 A1 Mar. 26, 2020

(30) Foreign Application Priority Data

Jun. 7, 2017 (IT) ..... 102017000062313

(51) Int. Cl.
*B67B 7/14* (2006.01)

(52) U.S. Cl.
CPC ..... *B67B 7/14* (2013.01)

(58) Field of Classification Search
CPC .. B67B 7/164; B67B 7/20; B67B 7/15; B67B 2007/166; B67B 7/162
(Continued)

(56) References Cited

U.S. PATENT DOCUMENTS 1,448,833 A 3/1923 De
3,158,879 A 12/1964 Barrett
(Continued)

FOREIGN PATENT DOCUMENTS

CN 105600511 A 5/2016

OTHER PUBLICATIONS

"Spring Cylinders" from Lehigh power as of Oct. 31, 2013. Retrieved from Wayback machine on Sep. 29, 2021 (Year: 2013).*
(Continued)

*Primary Examiner* — Orlando E Aviles
*Assistant Examiner* — Thomas Raymond Rodgers
(74) *Attorney, Agent, or Firm* — RMCK Law Group PLC

(57) ABSTRACT

A machine for removal and extraction of a lid for containers includes: a centering element, for aligning the machine above the container; a gripping device for acting upon a contained lid, being capable of disengaging the lid from the container and holding the same lid; a first device for moving said gripping device along a vertical axis, between first and second positions, proximal to, and away from said centering element and a support structure, fixed to said centering element, for supporting said first device. The gripping device takes first and second operating configurations, wherein it does not act upon said lid, and wherein it does act upon a protruding portion of the lid. The centering element has an abutment portion to abut against an upper container edge, and to prevent the container from moving, without exerting any force upon said edge.

8 Claims, 5 Drawing Sheets

(58) Field of Classification Search
USPC ..... 81/3.08, 3.07, 3.09, 3.15, 3.31, 3.27, 81/3.36, 3.37, 3.29, 3.32
See application file for complete search history.

(56) References Cited

U.S. PATENT DOCUMENTS 6,912,931 B1 * 7/2005 Draur ..... B67B 7/164 81/3.2
2016/0332857 A1 11/2016 Warren et al.

OTHER PUBLICATIONS

Chinese Office Action dated Jan. 6, 2021. 8 pages.
International Search Report dated Oct. 2, 2018. 2 pages.

* cited by examiner

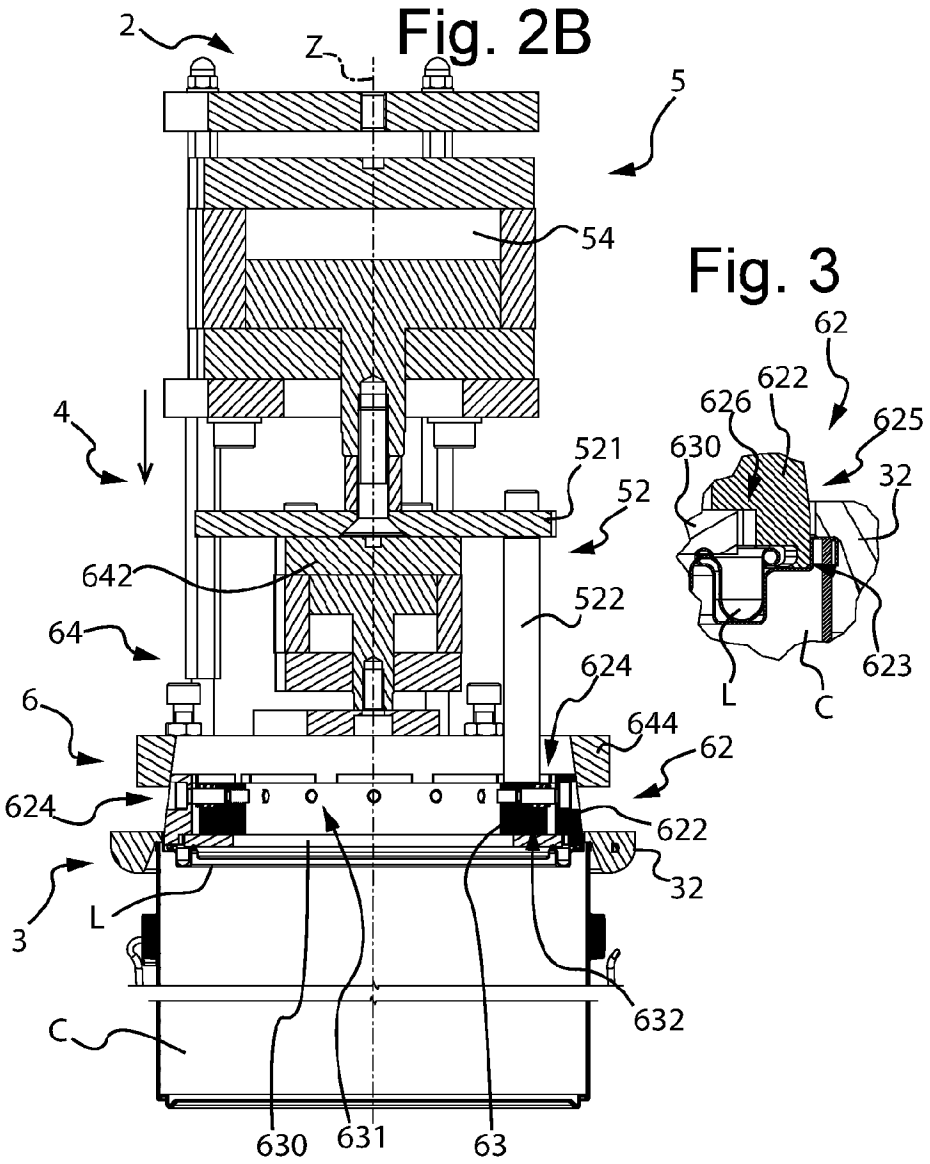
Fig. 2B
Fig. 3
5
54
Z
2
4
642
64
6
624
3
L
C
63
631
630
632
62
622
32
644
624
52
521
522
625
623
626
630
L
C
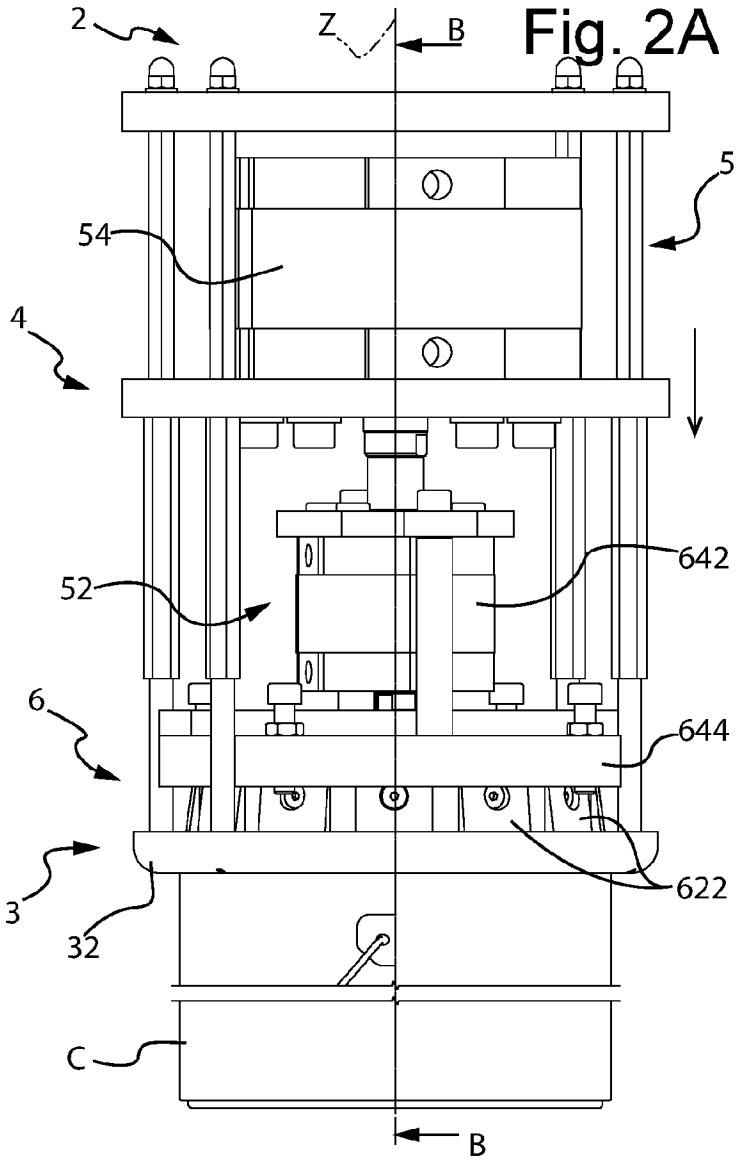
Fig. 2A
5
642
644
622
B
Z
2
54
4
52
6
3
32
C
B 2
3
4
5
6
52
54
62
64
32
642
644
B
Z
521
522
632
63
C
L
630
631
624
622
626
625
623

2
3
4
5
6
52
54
521
522
62
64
622
623
624
625
626
630
631
632
642
644
32
63
C
L
B

MACHINE FOR REMOVING A LID FROM A CONTAINER AND THE RELATED PLANT

CROSS-REFERENCE TO RELATED APPLICATIONS

This application is a 371 National Stage of International Application No. PCT/IB2018/054002, filed Jun. 5, 2018, which claims priority to Italian Patent Application No. 102017000062313 filed Jun. 7, 2017. The disclosure of each of the above applications is incorporated herein by reference in its entirety.

The present invention relates to an automatic machine capable of removing a lid from a container, which machine can be comprised in a plant for the production of fluids, such as paints.

The machine according to the present invention allows removing and extracting a lid from a container; in particular, the machine is suitable for containers having an outer top wall, partially annular, defining an aperture. In its portion of the inner peripheral edge of the top wall, the container defines an annular cavity open at the top adapted to receive the bottom surface of an annular channel open at the top comprised in the lid or cover to be removed. In its turn, the lid includes a portion protruding out of said cavity, through which the lid can be disengaged from the top wall of the container.

Manual systems for opening a lid from a container are known which are adapted to separate, at least partly, the lid from the container. Such systems exert a force upon said outer top wall of the container. This operation may cause deformation of the top wall of the container, with the risk of irreparably damaging said wall, so that sealing with the lid will no longer be ensured.

Manual mechanical systems are also known which are adapted to separate a metal lid from a container and allow complete removal thereof.

Such a system exerts a thrust force upon the outer top wall of the container, which force, though apparently distributed over most of the edge, is nevertheless considerable. This force will be proportional to the degree of connection between the lid and the container.

In this case as well, the force exerted by the system upon the outer top wall of the container may cause damage to the latter, thus preventing reuse thereof. This latter solution is exclusively applicable to metal lids; in fact, complete removal of the lid from the container requires interaction between the lid and a permanent magnet.

Therefore, the solution known in the art does not allow for complete removal of the lid from the container.

Manual mechanical systems are known from document US2016332857 which can open a container and remove the lid. However, a drawback of the solution described therein is that it causes deformation of the container, since a considerable force is exerted upon the outer top wall, which force may break and/or irreparably damage the container. Such a mechanical system does not include container holding systems for preventing the container from moving during the lid removal operations.

The present invention aims at solving these and other technical problems suffered by the prior art by providing an automated machine for removal of a lid from a container, which can act upon metal and/or plastic containers without exerting a force upon the outer top wall of the container that might cause deformation thereof and jeopardize the integrity and/or prevent subsequent reuse of the container.

One aspect of the present invention relates to a machine having the features set out in the appended claim 1.

A further aspect of the present invention relates to a system having the features set out in claim 10.

Further auxiliary features of the machine and/or plant are set out in the appended dependent claims.

The features and advantages of the machine and plant will become apparent in the light of the following patent description of several possible embodiments and of the annexed drawings, wherein:

FIGS. 1A, 1B and 1C are perspective views of one possible embodiment of the machine for removal of a lid, placed above a container, in three different operating configurations; FIG. 1A shows the machine in a first operating configuration; FIG. 1B shows the machine in a second operating configuration; FIG. 1C shows the machine in a third operating configuration;

FIGS. 2A and 2B show the machine of FIG. 1A in a front view; in particular, FIG. 2A shows a front view of the machine; FIG. 2B shows the machine in a sectional view relative to a vertical plane B-B;

FIG. 3 shows a detail of the gripping device of the machine of FIG. 2B;

FIG. 4A shows a front view of the machine; FIG. 4B shows the machine in a sectional view relative to a vertical plane B-B;

FIG. 6A shows a front view of the machine; FIG. 6B shows the machine in a sectional view relative to a vertical plane B-B;

Figure 1C:
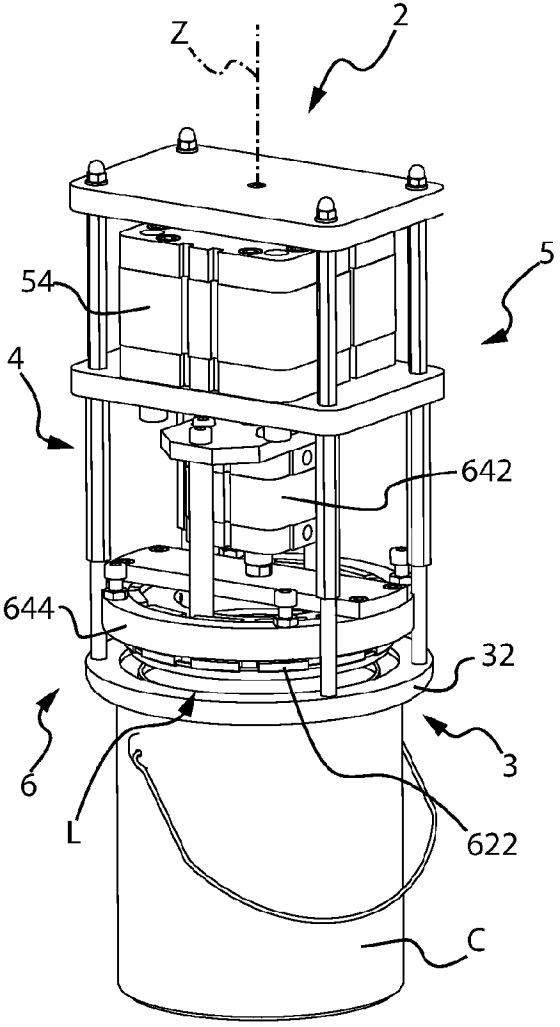

With reference to the above-listed drawings, the machine for removal of a lid "L" from a container "C" is designated as a whole by reference numeral 2.

Machine 2 is suitable for removal and extraction of a lid "L" for paint and/or dye containers or cans "C".

Said container "C" and said lid "L" have the technical and structural features previously described in the present description. Lid "L" is also known in the industry as "pressure lid". This type of lids coupled to containers are capable, at least in some embodiments thereof, of ensuring a hermetic seal.

Machine 2 according to the present invention comprises: a centring element 3, adapted to allow properly aligning machine 2 above container or can "C". Said centring element 3 allows machine 2 to be correctly positioned above container "C" prior to removal and extraction of lid "L".

Machine 2 comprises a gripping device 6. Said gripping device 6 is adapted to selectively act upon at least two points of a lid "L" placed on container "C". Preferably, said gripping device 6 is adapted to act upon a lid "L" when the latter is closing a container "C". Preferably, said gripping device 6 is adapted to selectively act upon a portion of lid "L" protruding out of a cavity comprised in container "C", in which an annular channel open at the top, comprised in lid "L", is positioned.

Said gripping device 6 is capable of both disengaging lid "L" from container "C", thus removing it, and holding the same lid "L", so that it can be extracted. Preferably, said gripping device 6 is adapted to remove the annular channel of lid "L" from the cavity comprised in container "C".

Machine 2 according to the present invention further comprises a first moving device 5.

Said first moving device 5 is adapted to move said gripping device 6. The movement of gripping device 6 preferably occurs along a vertical axis "Z". The movement occurs between at least one first position, proximal to said centring element 3, in which said gripping device 6 is proximal to said centring element 3, and at least one second position, away from said centring element 3. Such movement made by the first moving device 5 allows moving gripping device 6 towards and away from container "C", thus allowing gripping device 6 to interact with the lid "L" and/or remove the lid "L" by extracting it from container "C" and/or moving it away from the same container "C".

Machine 2 further comprises a support structure 4. Said support structure 4 is fixed to said centring element 3. Said support structure 4 is adapted to support said first moving device 5.

Said gripping device 6 is adapted to take a first operating configuration, wherein it is non-influential upon a protruding portion of lid "L", since it does not act upon said protruding portion of lid "L"; and a second operating configuration, wherein it is adapted to act upon a protruding portion of the annular channel open at the top, comprised in lid "L".

Said centring element 3 comprises an abutment portion 32. Said abutment portion 32 is adapted to abut against an upper edge of the outer top wall of container "C", hereafter defined as outer top wall. The same abutment portion 32 is adapted to prevent container "C" from moving, in particular while switching between the different operating configurations of machine 2, and in particular while switching between the different operating configurations and/or positions of gripping device 6, without exerting any pressure force upon said outer top wall of container "C", in any operating configuration or spatial arrangement of gripping device 6.

Machine 2 according to the present invention exerts no voluntary forces upon the edge of the outer top wall of container "C".

In a preferred embodiment of machine 2 according to the present invention, said first moving device 5 comprises: a connection structure 52, to which gripping device 6 is fixed; a first actuator device 54, of the linear type, adapted to move said connection structure 52 along said vertical axis "Z".

In a preferred embodiment of machine 2 according to the present invention, said gripping device 6 in turn comprises: at least two gripping elements 62. Each gripping element 62 is adapted to selectively act upon one protruding portion of lid "L".

Said gripping device 6 further comprises at least one support element 63. To said support element 63, at least two gripping elements 62 are operationally connected.

Said gripping device 6 further comprises at least one second moving device 64.

Said second moving device 64 is adapted to move said at least two gripping elements 62 between the different operating configurations of gripping device 6. In particular, said moving device 64 is adapted to move said gripping device 6, and in particular said gripping elements 62, between a first operating configuration, in which said gripping elements 62 are not adapted to act upon said lid "L"; and a second operating configuration, in which said gripping elements 62 are adapted to act upon a protruding portion of the annular channel open at the top of lid "L".

In a preferred embodiment of machine 2, the second moving device 64 comprises a second actuator device 642. Said second actuator device 642 is preferably of the linear type.

Said second moving device 64 further comprises a driving element 644.

Said driving element 644 is adapted to act upon said gripping elements 62.

During its linear movement, said second actuator device 642 acts, through said driving element 644, upon said gripping elements 62, allowing said gripping elements 62 to selectively take either said first operating configuration or said second operating configuration. Preferably, said driving element 644 is shaped in such a way as to simultaneously act upon all gripping elements 62.

In a preferred embodiment of machine 2 according to the present invention, each gripping element 62 comprises a coupling portion 623.

Said coupling portion 623 has a shape complementary to the shape of the protruding portion of lid "L". In particular, said protruding portion of lid "L" can at least partly be housed in said coupling portion 623. In particular, said protruding portion of lid "L" is housed, at least partly, in said coupling portion 623 when gripping device 6 is in said second operating configuration.

Said coupling portion 623 is adapted to at least partly house, inside of it, said protruding portion of lid "L". In particular, in the second operating configuration of gripping device 6, coupling portion 623 houses, at least partly, said protruding portion of lid "L" while preferably exerting a force thereupon.

In general, said gripping device 6 is adapted to exert a thrust force upon said protruding portion of lid "L", thereby deforming said annular channel open at the top comprised in lid "L", without exerting any force upon said container "C"; therefore, the thrust force exerted by gripping device 6 will not deform container "C" in any way. In particular, in the second operating configuration, said gripping device 6 exerts such a thrust force as to deform said annular channel of lid "L", thus decoupling the same lid "L" from container "C".

In general, the force exerted upon lid "L" by gripping device 6 preferably has at least two components, each one having a direction perpendicular to said vertical axis "Z". In particular, each gripping element 62 will be able to exert a force along a direction perpendicular to said vertical axis "Z". Therefore, the greater the number of gripping elements 62, the greater the force components applied onto lid "L" and having a direction perpendicular to said vertical axis "Z". The direction and/or sense of the force of gripping elements 62 will be mutually different.

In a preferred embodiment of gripping device 6, said gripping element 62 comprises a first matching portion 625. The first matching portion 625 of gripping element 62 is acted upon by said driving element 644.

The action upon the first matching portion 625 exerted by said driving element 644, the latter being pushed by the second actuator device 642, allows gripping element 62 to switch between said first operating configuration and said second operating configuration, and vice versa.

In a preferred embodiment of machine 2 according to the present invention, said gripping element 62 and said second moving device 64 are so made that the thrust action exerted along said vertical axis "Z" upon the first matching portion 625 of gripping element 62 by the second actuator device 642, through said driving element 644, is transformed into a substantially straight movement of coupling portion 623 along an axis perpendicular to said vertical axis "Z".

In one possible embodiment, said driving element 644 acts, as it moves along vertical axis "Z", upon the first matching portion 635, which corresponds to the outer face of gripping element 62. Said matching portion 635 comprises an inclined portion, so that the interaction with said driving element 644 will vary during the vertical movement of driving element 644, achieved through said second actuator device 642. For example, said matching portion 635 is configured in a manner such that during the downward movement of driving element 644 the action exerted upon gripping element 62 by the same driving element 644 will increase, and vice versa.

On the contrary, said coupling portion 623 is located on the inner face of gripping element 62, facing towards lid "L".

In a preferred embodiment, said driving element 644 is a ring adapted to act upon a plurality of gripping elements 62, the latter being arranged along a circumference, preferably angularly equidistant from each other.

In an alternative embodiment, said gripping element 62 and said second moving device 64 are so made that the thrust action exerted along said vertical axis "Z" upon the first matching portion 625 of gripping element 62 by the second actuator device 642, through said driving element 644, is transformed into a substantially rotary movement of coupling portion 623 about an axis perpendicular to said vertical axis "Z".

In the preferred, though exemplary and non-limiting, embodiment of machine 2 according to the present invention, said support element 63 comprises a plurality of housings 631.

In each one of said housings 631, at least one elastic element 632 is housed.

Each elastic element 632 is adapted to exert a thrust force against a corresponding gripping element 62, with which the elastic element 632 is associated.

In particular, elastic element 632 is adapted to interact with a hooking portion 622 of gripping element 62, with which it is associated.

The thrust force exerted on said gripping elements 62, and in particular on hooking portions 622, by elastic elements 632 is such as to bring gripping device 6, and in particular gripping elements 62, into the first operating configuration.

Each elastic element 632 is inserted, at a first end thereof, into said housing 631 comprised in support element 63, and, at a second end thereof, opposite to the first one, is adapted to act against said hooking portion 622.

In general, said hooking portion 622 of gripping element 62 is adapted to connect said gripping element 62 to said support element 63 through a corresponding elastic element 632, thereby allowing gripping element 62 to be moved between the different operating configurations.

Preferably, said elastic element 632 comprises a spring and a removable fixing element. Said spring is arranged coaxial and concentric to said fixing element, surrounding a central portion thereof. A first end of the fixing element is adapted to be removably fixed into said housing 631, e.g. by screwing. The opposite end of said fixing element is inserted in a connection portion 624, e.g. a housing, comprised in hooking portion 622. Said connection portion 624 is shaped in such a way as to define a housing in which one end of said fixing element of the elastic element 632 is inserted, thus retaining it. Preferably, the end of said fixing element of elastic element 632, inserted in connection portion 624, comprises a head adapted to interact with said connection portion 624, so that it will be prevented from coming out. Said head of the fixing element of elastic element 632 preferably comprises a coupling element to be coupled to a suitable wrench for tightening said fixing element of elastic element 632.

Said elastic element 632, e.g. in the above-described embodiment, can be removed from housing 631 and decoupled from hooking portion 622 of gripping element 62, e.g. the fixing element can be removed from connection portion 624. In this embodiment of elastic element 632 and gripping element 62, the latter can be replaced and/or removed, e.g. for maintenance and/or in order to adapt gripping element 62 to the conformation of the protruding portion of lids "L" to be removed. It is therefore possible to replace gripping elements 62 with other gripping elements having an appropriately shaped coupling portion 623, according to the shape and/or material of the protruding portion of lid "L".

Each elastic element 632 is adapted to bring the gripping element 62 into its first operating configuration upon completion of the action exerted by driving element 644 upon the same gripping element 62, and in particular upon said first matching portion 625.

Said elastic element 632, e.g. the coil-spring component, is subject to deformation when gripping element 62 is in its first operating configuration, in particular when driving element 644 is acting upon gripping element 62.

Preferably, following the movement of gripping device from the first operating configuration to the second operating configuration, each gripping element 62 comes in mechanical abutment with said support element 63. In particular, a second matching portion 626 of gripping element 62 comes in abutment with a stop portion 630 comprised in support element 63, thereby preventing any further movement of gripping element 62.

Said stop portion 630 is adapted to define the travel of said gripping element 62, in particular the achievement of said second operating configuration, following the movement caused by the second moving device 64.

In a preferred, though exemplary and non-limiting, embodiment of machine 2, when gripping device 6 switches from the first operating configuration to the second operating configuration, said second actuator device 642 is activated and moves, preferably extends, along said vertical axis "Z". The movement of the second actuator device 642 involves an equal movement of driving element 644. The movement of driving element 644 causes a movement of gripping elements 62 as indicated above, in particular under the action exerted by driving element 644 upon the first matching portions 625 of gripping elements 62. The movement of gripping elements 62 causes compression of elastic elements 632. The movement of gripping elements 62 stops when gripping elements 62, and in particular the second matching portions 626, abut against said stop portion 630 of support element 63.

The movement of gripping elements 62 allows coupling portions 623 to act upon the protruding portion of lid "L".

Conversely, when the gripping device switches from the second operating configuration to the first operating configuration, said second actuator device 642 is activated and moves, preferably contracts, relative to said vertical axis "Z". The movement of the second actuator device 642 involves an equal movement of driving element 644. The movement of driving element 644 reduces the action exerted by driving element 644 upon gripping elements 62, and in particular upon the first matching portions 625.

The reduction of the action exerted upon gripping elements 62 by the driving element allows elastic elements 632 to extend. The extension of elastic elements 632 allows exerting a force upon said gripping elements 62, which are then moved back into their first operating configuration.

The movement of gripping elements 62 causes coupling portions 623 to be decoupled from the protruding portion of lid "L". In this condition, gripping elements 62, and in particular coupling portions 623, are no longer acting upon the protruding portion of lid "L".

A preferred embodiment of machine 2 according to the present invention comprises a plurality of gripping elements 62, e.g. twelve.

Said gripping elements 62 are rigid structures, e.g. made of metal or very hard plastic material. Gripping elements 62 are angularly equidistant from each other, in order to distribute the action evenly onto the outer protruding portion of lid "L".

Figure 1B:
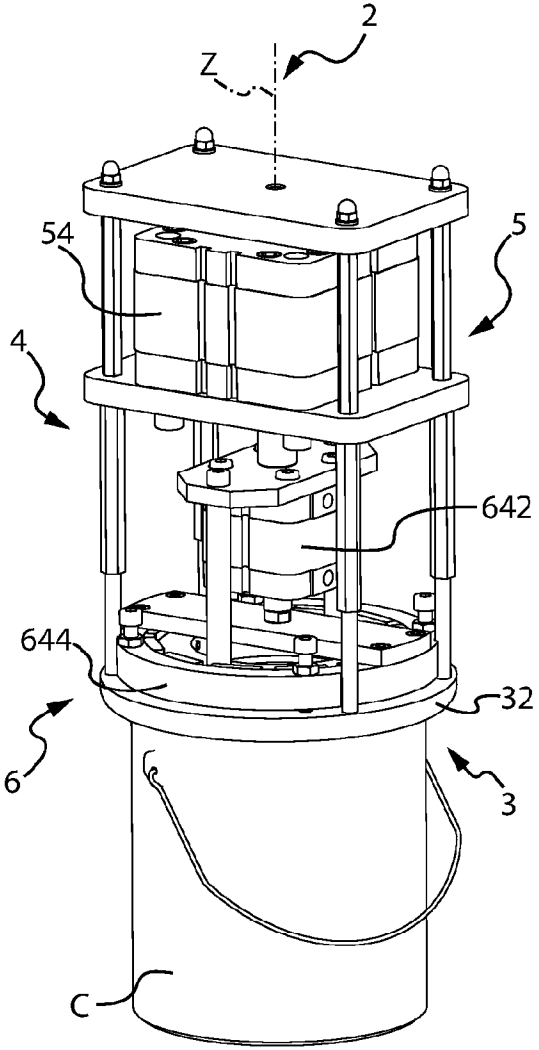
Figure 1A:
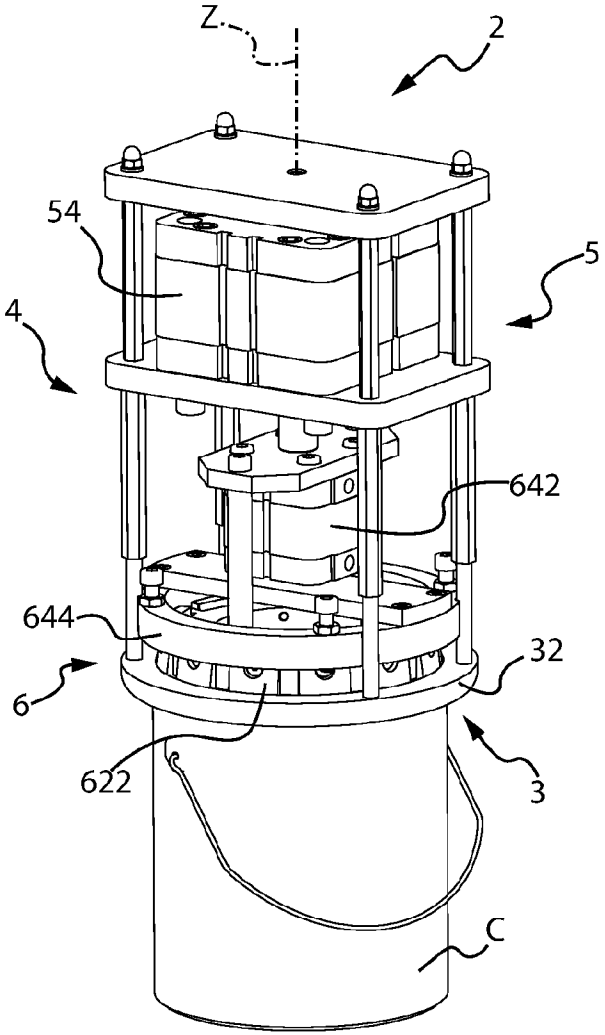

In the preferred embodiment of machine 2 according to the present invention, said first moving device 5 and said second moving device 64 are completely independent of each other, since they can be activated autonomously. In fact, in a first operating configuration machine 2 is adapted to extend said first moving device 5, while keeping said second moving device 64 contracted, e.g. as shown in FIG. 1A. In a second operating configuration, machine 2 is adapted to extend said first moving device 5, while also extending said second moving device 64, e.g. as shown in FIG. 1B. In a third operating configuration, machine 2 is adapted to contract said first moving device 5, while extending said second moving device 64, e.g. as shown in FIG. 1C. In a fourth operating configuration, machine 2 is adapted to contract said first moving device 5, while also contracting said second moving device 64.

In this embodiment of machine 2 it is possible to prevent a pressure force, caused by an extension of a moving device (5, 64), from being exerted upon container "C", while nevertheless allowing the removal of lid "L".

Moreover, with this embodiment of machine 2 it is possible to move lid "L" away from container "C" after opening container "C", while possibly holding lid "L".

Said first actuator device 54 is preferably a pneumatic actuator. In an alternative embodiment, said first actuator device 54 is of the hydraulic type.

Said second actuator device 642 is preferably a pneumatic actuator. In an alternative embodiment, said second actuator device 642 is of the hydraulic type.

In general, said stop portion 630 also abuts on an edge of lid "L", so that said gripping element 62 can effectively act upon the protruding portion of lid "L", deforming the annular channel open at the top comprised in the same lid "L".

In one possible embodiment, said support structure 4 preferably comprises: tubular elements, connected to said centring element 3; and a plate, whereon said first actuator device 54 is fixed. Said tubular elements are also fixed to said plate.

Said support structure 4 is capable of keeping said abutment portion 32 of centring element 3 at a predefined distance from the first actuator device 54. Support structure 4 prevents that the movement of the elements comprised in machine 2 might cause the application of a compression force onto the edge of the outer top wall of container "C", whereon said centring portion 32 is made to rest. Preferably, the movements that involve an actual application of force onto lid "L", such as to cause it to be decoupled from container "C", are exerted during downward movements of the moving devices (5, 64). The conformation of gripping device 6 is such that during said movements no voluntary force will be applied onto said outer top wall of container "C" which may possibly cause deformation of the edge of container "C" itself. Preferably, the movements that involve an actual application of force onto lid "L", such as to definitively separate it from container "C", are exerted during upward movements of the moving devices, and in particular of said first moving device 5.

This type of force, intended to ensure the actual separation of lid "L" from container "C", is normally less than the force required for decoupling lid "L" from container "C". In this case as well, therefore, any force transmitted to the outer top wall of container "C" will be very weak, and certainly insufficient to cause the same wall to undergo any deformation.

Furthermore, since said abutment portion 32 of centring element 3 has a circular shape, such as to abut on the entire edge of the outer top wall of container "C", any involuntary forces that can be transmitted to the outer top wall of container "C" are equally distributed, thus further reducing the risk that any involuntary force transmitted to the outer top wall of container "C" might cause such a compression of the same wall that might lead to deformation thereof.

Said support structure 4 and said centring element 3 define the transversal extension of machine 2. The first moving device and gripping device 6 lie within the structure defined by the same support structure 4 and by centring element 3.

In one possible embodiment, said connection structure 52 preferably comprises a plurality of columns 522 and a plate 521.

Said plate 521 constrains the mobile portion of the first actuator device 54 to the fixed portion of said second actuator device 644.

At one end, said columns 522 are fixed to said plate 521. To the opposite end of said columns 522, said support element 63 is fixed, which comprises a plurality of housings 631 in which said elastic elements 632 are housed.

To the mobile portion of the second actuator element 642, said actuator element 644 is fixed, so that it can be moved relative to said support element 63 and said gripping elements 62.

In general, machine 2 can be positioned above container "C" manually, wherein an operator positions machine 2 above container "C" either manually or by means of a servomechanical system. Once machine 2 has been positioned and properly centred on the container, the same machine is activated in order to separate lid "L" from container "C" and then open said container.

In a more automated embodiment, machine 2 can be positioned above container "C" automatically, by appropriately controlling a moving device 16 connected to the same machine 2. Said moving device 16 can position and centre machine 2 on container "C" in order to activate the same machine 2, preferably automatically, and separate lid "L" from container "C" and possibly hold lid "L", thus definitively removing lid "L" from container "C".

Machine 2 according to the present invention is particularly suitable for inclusion in a plant 1 for dyeing products, such as paints.

In general, a plant 1 for dyeing products comprises: at least one processing station 12, adapted to process dyeing products contained in a container "C"; and at least one moving device 14.

Said moving device 14 is adapted to move one or more containers "C" from and/or to a processing station 12.

Said moving device 14 may be a series of rollers and/or a conveyor belt, or other moving devices capable of moving at least one container "C" along a horizontal axis.

Said at least one processing station 12 may be a dosing station and/or a sampling station and/or a mixing station.

Machine 2 can be included in system 1 either upstream or downstream of a processing station 12.

In one possible embodiment of system 1 according to the present invention, machine 2 is placed in proximity to the inlet of a processing station 12.

System 1 further comprises at least one moving device 16 adapted to move said machine 2.

In general, said machine 2 can be moved by means of a moving device 16. Said moving device 16 is at least capable of moving said machine 2 along a vertical axis "Z".

Said moving device 16 allows machine 2 to be positioned above container "C".

In a preferred embodiment, said moving device 16 is a manipulator, e.g. an articulated arm, having at least one degree of freedom.

FIG. 1A shows, in a perspective view, machine 2 according to the present invention placed above a container "C". Centring element 3 allows machine 2 to be configured at best, while also positioning abutment portion 32 on the outer top wall of container "C". Machine 2 shown in FIG. 1A is in a first operating configuration. Said first moving device 5, and in particular said first actuator device 54, is configured in such a way as to position said gripping device 6 in the first position proximal to said centring element 3.

The second moving device 64 is prearranged in such a way as to set said gripping elements 62 in a first operating configuration, in which they do not act upon said lid "L". In fact, driving element 644 is in a raised position.

In this configuration, coupling portions 623 of the various gripping elements 62 do not interact with the protruding portion of lid "L". Moreover, said stop portion 630 abuts against lid "L".

In the drawing one can also clearly see the substantially vertical development of machine 2 according to the present invention. Machine 2 also looks very compact, since it has substantially the same dimensions as the illustrated container "C".

From this figure one can understand how support structure 4 keeps the first actuator device 54, and in particular the fixed portion thereof, at a predefined distance from said abutment portion 32 of centring element 3. This prevents any compression forces from being applied onto the edge of the outer top wall of container "C".

FIG. 1B shows, in a perspective view, machine 2 according to the present invention placed above a container "C". Machine 2 shown in FIG. 1B is in a second operating configuration.

From a comparison between FIG. 1B and FIG. 1A it emerges that also in this operating configuration of machine 2 said first moving device 5 keeps said gripping device 6 in the first position, proximal to said centring element 3.

The second moving device 64, on the contrary, is prearranged in such a way as to set said gripping elements 62 in the second operating configuration, in which they act upon a protruding portion of lid "L". In fact, said driving element 644 is in a lowered position.

In the second operating configuration, said coupling portions 623 of gripping elements 62 interact with the protruding portion of lid "L". In particular, at least a part of the protruding portion of lid "L" is housed in coupling portion 623 of each gripping element 63.

This figure highlights one possible embodiment of the second moving device 64 in order to allow driving element 644 to be moved along said axis "Z" through the movement of said second actuator device 642.

FIG. 1C shows, in a perspective view, machine 2 according to the present invention placed above a container "C" in a third operating configuration.

In the third operating configuration of the machine, compared with the one shown in FIG. 1B, said abutment portion 32 still abuts on the outer top wall of container "C"; the first moving device 5, and in particular said first actuator device 54, is configured in such a way as to position said gripping device 6 in the second position, away from said centring element 3. In comparison with FIGS. 1A and 1B, in fact, one can see that gripping device 6, and more visibly the second actuator device 642, has come nearer to the first actuator device 54. Moreover, gripping elements 62 and support element 63 have moved away from abutment portion 32 of the centring element 3. Therefore, gripping device 6 has moved away from container "C".

During the transition from the second configuration, shown in FIG. 1B, to the third configuration of machine 2, it is clear that lid "L" has been removed from container "C".

Support structure 4, being rigid, prevents the movements made by the first moving device 5 and/or by the second moving device 64 from translating into the exertion of a compression force upon the edge of the outer top wall of container "C", whereon said abutment portion 32 of centring element 3 abuts.

FIG. 2A shows the machine of FIG. 1A in a front view. The machine, in the first operating configuration, is positioned on container "C". In this image it is visible that the first moving device 5 and gripping device 6 extend along a vertical axis "Z".

In this image, a plurality of gripping elements 62, in particular hooking portions 622, are visible. The image shows driving element 644 adapted to act upon said gripping elements 62.

FIG. 2A also shows the conformation of the support structure 4 to which said centring element 3 is connected. The same FIG. 2A clearly shows how said first moving device 5 puts said gripping device 6 into the first position proximal to said centring element 3, and that said second actuator device 642 is in the configuration in which it does not push said driving element 644 downwards.

FIG. 2B shows the machine of FIG. 1A in a sectional front view according to the vertical plane B-B. The machine is placed on container "C", so that abutment portion 32 is on the outer top wall of container "C". Stop portion 630 lies on lid "L", matching therewith.

From this figure it emerges that said support element has a circular shape, around which said gripping elements 62 are arranged.

Also said driving element 644 has a circular shape, and surrounds said plurality of gripping elements 62.

FIG. 2B allows understanding how the second actuator device 642, and in particular the fixed portion thereof, is fixed to said plate 521, from which columns 522 extend, to opposite ends of which said support element 63 is fixed. Through said connection structure 52, the first actuator device 54 is able to move said gripping device 6.

Said driving element 644 is fixed to the mobile part of the second actuator device 642.

In the drawing also housings 631 are visible, each one of which houses an elastic element 632. Said elastic element 632 is constrained to said hooking portion 622 of gripping element 6, since one end thereof is within connection portion 624.

Elastic element 632 is in an extended configuration, exerting a thrust force upon said gripping element 62 to move it away from the same support element 63.

FIG. 3 shows a detail of gripping device 6 of the machine of FIG. 2B. Said FIG. 3 shows hooking portion 622 and coupling portion 623. This figure shows gripping device 6 in its first operating configuration, in which coupling portion 623 does not act upon the protruding portion of lid "L".

This figure also partially shows the first matching portion 625 and the second matching portion 626.

The figure also shows stop portion 630 abutting against lid "L". Abutment portion 32 of centring element 3 abuts on the outer top wall of container "C".

In the first operating configuration of gripping device 6, every spring or elastic element 632 is extended, thus pushing the corresponding gripping element 62; while the fixing element of each elastic element 632 abuts against connection portion 624, and in particular against the bottom of the housing.

Figures 4A, 4B, 5:
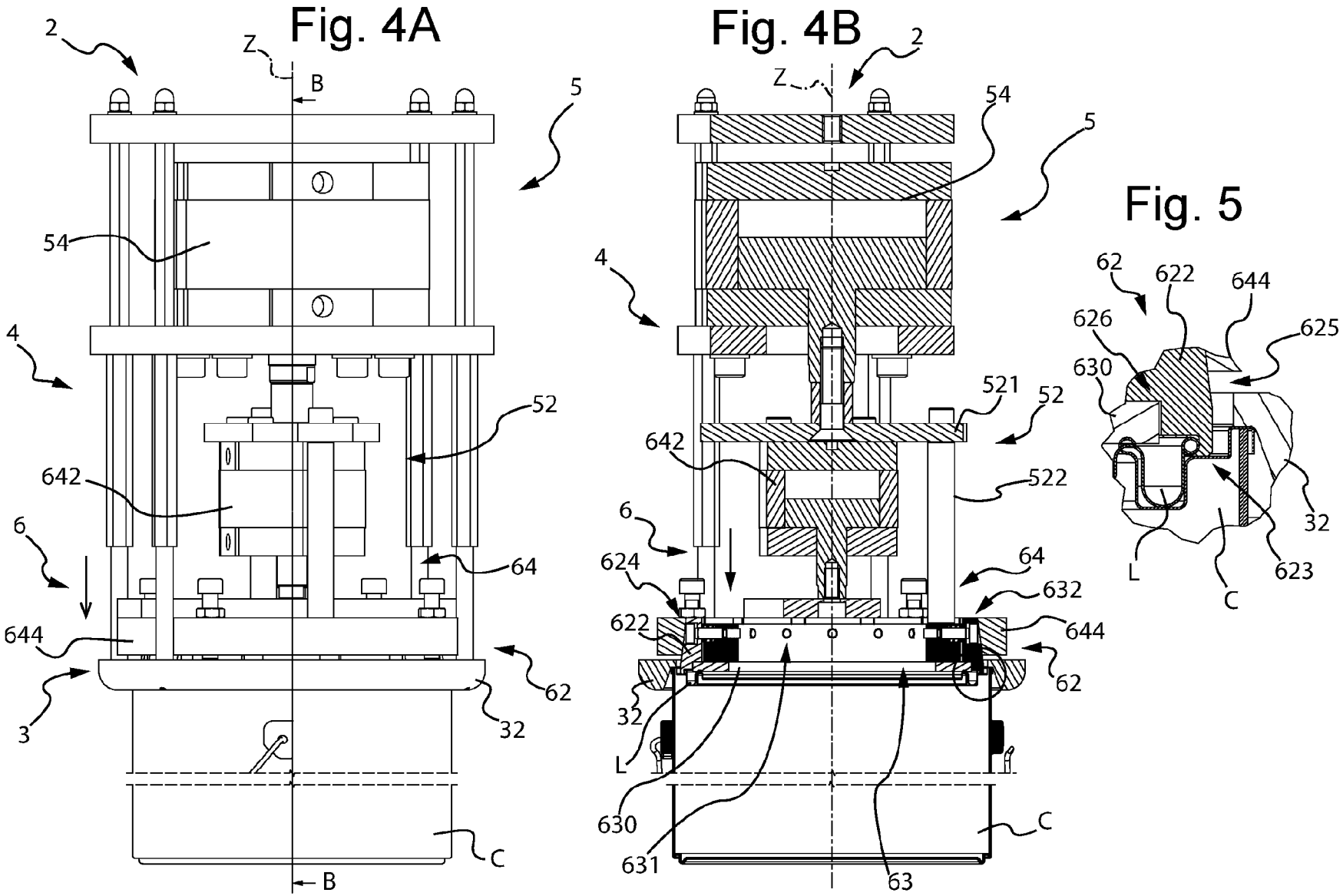
FIGS. 4A and 4B show the machine of FIG. 1B in a front view; in particular.
FIG. 5 shows a detail of the gripping device of the machine of FIG. 4B.

FIG. 4A shows the machine of FIG. 1B in a front view. The machine is in the second operating configuration, in which gripping device 6 is in the second operating configuration, interacting with lid "L". In particular, said coupling portion 623 houses, inside of it and at least partly, the protruding portion of lid "L".

In the second operating configuration of gripping device 6, said driving element 644 is moved by said second actuator device 642, thus acting upon said plurality of gripping elements 62.

Said centring element 3 rests, through said hooking portion 32, on container "C". During the transition between the first operating configuration of machine 2 and the second operating configuration, and in particular from the first operating configuration to the second operating configuration of gripping device 6, no pressure force is exerted upon container "C".

FIG. 4B shows the machine of FIG. 1B in a sectional front view according to the vertical plane B-B.

Also in this operating configuration, machine 2 is placed on container "C", so that abutment portion 32 lies on the edge of the outer top wall of container "C". Stop portion 630 lies on lid "L", matching therewith.

Said second actuator device 642 is in the configuration in which it pushes said driving element 644, causing the same driving element 644 to act upon said plurality of gripping elements 62. By pressing against said gripping elements 62, the latter are moved and drawn closer to each other. In particular, the movement of driving element 644 along vertical axis "Z" allows each gripping element 62 to make a movement along an axis perpendicular to said vertical axis "Z", radially to lid "L". In particular, driving element 644, as it moves, acts upon said first matching portion 625 of the various gripping elements 62.

Following the movement made by the second moving device 64, each elastic element 632 is compressed by the same gripping elements 62, which approach support element 63. As they approach support element 63, gripping elements 62 abut, through said second matching portion 626, against said stop portion 630.

FIG. 5 shows a detail of gripping device 6 of the machine of FIG. 4B, in which hooking portion 622 and coupling portion 623 are visible. FIG. 5 shows gripping device 62 in its second operating configuration, in which coupling portion 623 acts upon lid "L".

This figure also partially shows the first matching portion 625, whereon said driving element 644 abuts, and the second matching portion 626, which abuts against said stop portion 630.

The figure also shows that stop portion 630 abuts against lid "L"; that abutment portion 32 of centring element 3 abuts on the edge of the outer top wall of container "C"; and that the protruding portion of lid "L" is inserted in the housing defined by said coupling portion 623.

Figures 6A, 6B, 7:
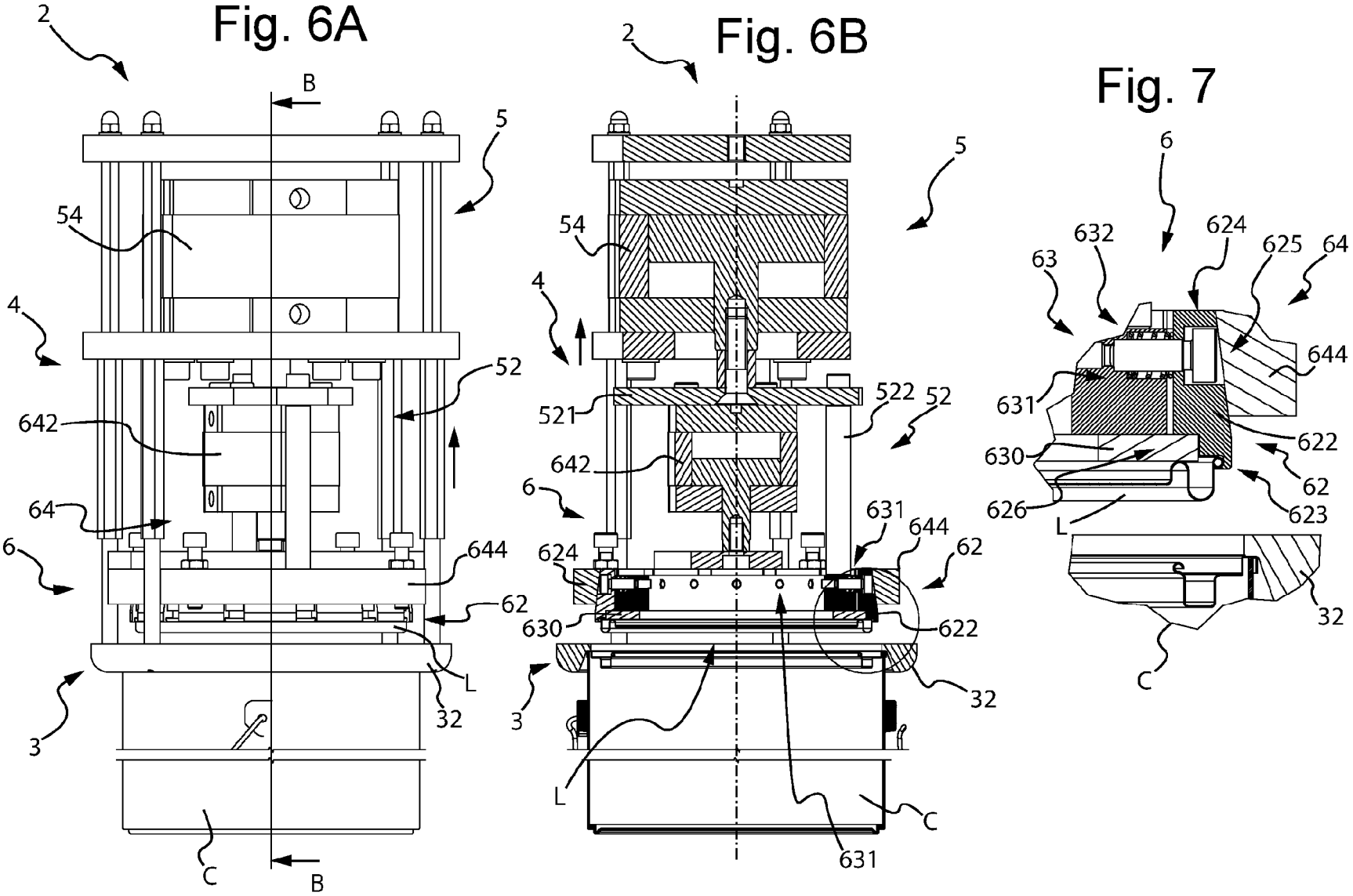
FIGS. 6A and 6B show the machine of FIG. 1C in a front view; in particular.
FIG. 7 shows a detail of the gripping device of the machine of FIG. 6B.

FIG. 6A shows machine 2 of FIG. 1C in a front view.

In the third operating configuration of machine 2, gripping device 6 continues to interact with lid "L". The movement made by the first moving device 5, which brings said gripping device 6 into the second position, distant from said centring element 3, allows lid "L" to be definitively separated from container "C".

Said centring element 3 and said support structure 4 ensure that, during the transition between the second operating configuration and the third operating configuration of machine 2, and in particular from the first position to the second position of gripping device 6, no voluntary pressure force will be exerted upon the outer top wall of container "C".

In this third operating configuration, machine 2 has removed lid "L" from container "C", without exerting any compression forces upon container "C". Moreover, in this third operating configuration machine 2 is able to hold lid "L" once it has been definitively separated from container "C".

FIG. 6B shows the machine of FIG. 1C in a sectional front view according to the vertical plane B-B. The machine is placed on container "C", so that abutment portion 32 lies on the outer top wall of container "C" and stop portion 630 still lies on lid "L", matching therewith.

Said second actuator device 642 is still in the configuration in which it pushes said driving element 644, causing the same driving element 644 to act upon said plurality of gripping elements 62. Each elastic element 632 continues to be compressed by the same gripping elements 62 approaching support element 63.

Although it is far from container "C", gripping device 6 is able to hold lid "L" even when it has been separated from container "C".

The first actuator device 54 has moved gripping device 6, bringing it into said second position, so that lid "L" can be separated from container "C".

FIG. 7 shows a detail of the gripping device of the machine of FIG. 6B, wherein hooking portion 622 and coupling portion 623 are clearly visible. This figure shows that gripping device 6 is in its second operating configuration, even though gripping device 6 is in the second position, away from centring element 3. In this operating configuration of machine 2, coupling portion 623 continues to act upon lid "L", in particular by interacting with said protruding portion, even though lid "L" has been definitively separated from container "C".

In FIG. 7 one can see how the driving element acts upon the first matching portion 625. Said gripping element 62 abuts, through said second matching portion 626, against said stop portion 630 of support element 63. The figure also shows that stop portion 630 still abuts against lid "L".

Abutment portion 32 of centring element 3 still abuts on the outer top wall of container "C". In the figure it is clearly visible that said elastic element 632 remains compressed. In particular, it is visible that the spring is compressed because gripping element 62 is being pushed by driving element 644.

The fixing element of elastic element 632 no longer abuts against connection portion 624, and in particular in the housing.

Figure 8:
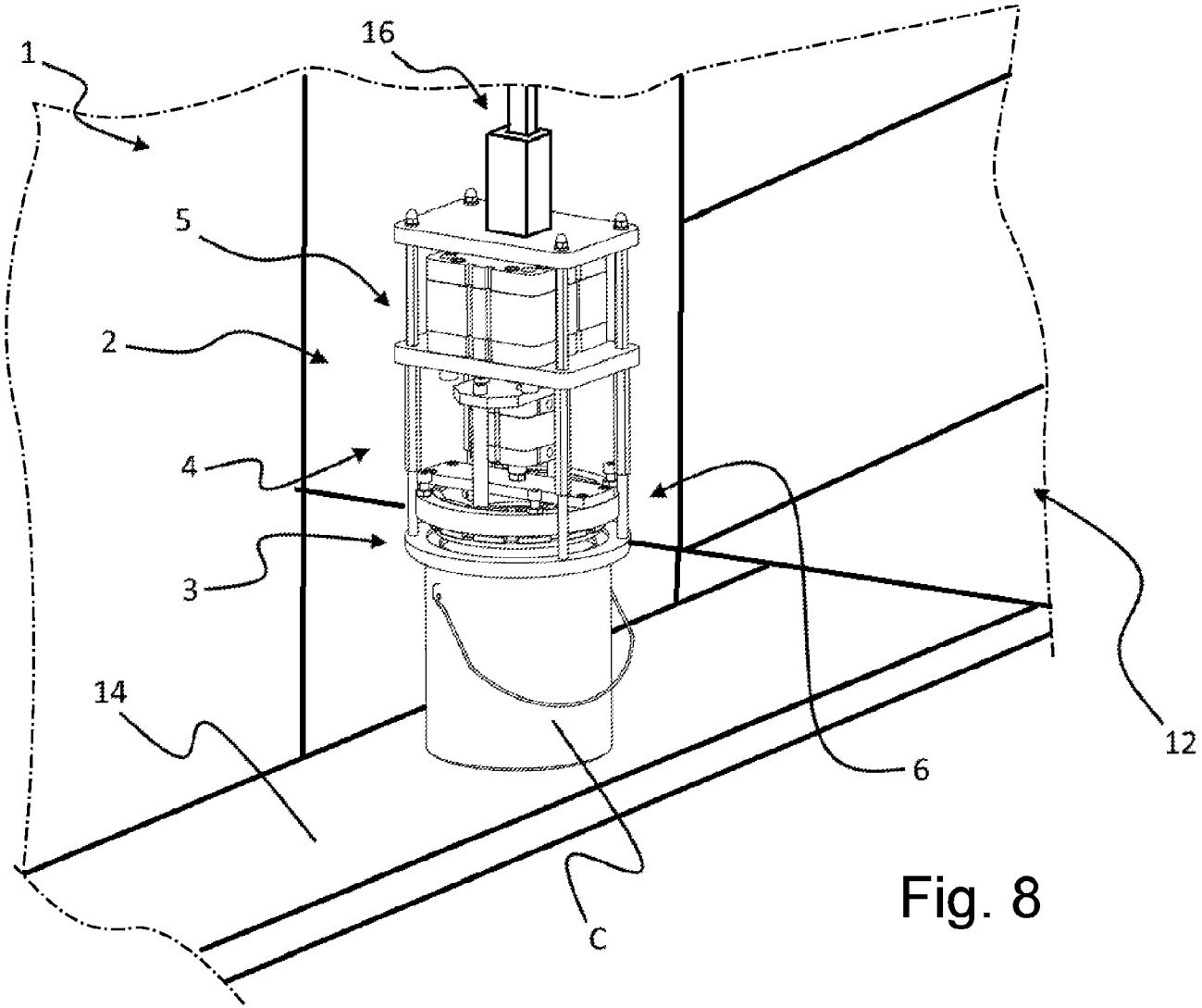
FIG. 8 shows, in a schematic manner, a plant comprising the machine for removal of a lid from a container according to the present invention.

FIG. 8 shows, in a schematic manner, a plant 1 comprising machine 2 for removal of a lid "L" from a container "C" according to the present invention.

FIG. 8 shows a container "C" on moving means 14, whereon container "C" can move.

Said moving means 14 may be a conveyor belt or a series of rollers.

The container is in proximity to a processing station 12, adapted to perform an operation on container "C" and/or on the content of container "C".

Machine 2 is placed on container "C". The illustrated machine 2 is in the third operating configuration, in which lid "L" has been removed from container "C".

Machine 2 is adapted to rest on container "C". The same machine 2 is moved by means of a moving device 16, shown as an arm, which can move the entire machine 2 at least along a vertical axis "Z".

Machine 2 according to the present invention is capable of removing a lid "L" without exerting any voluntary compression forces upon the outer top wall of container "C" on which lid "L" has been applied.

Machine 2 according to the present invention, since it comprises a centring element 3 adapted to centre machine 2 while retaining container "C" and a gripping device 6 capable of removing lid "L", does not exert any voluntary thrust forces upon the outer top wall of container "C", which wall defines the aperture on which lid "L" to be removed has been positioned.

Gripping device 6, and in particular said gripping elements 62, can be replaced in order to set up machine 2 with those gripping elements 62 that are most suitable for the protruding portion of lids "L", by selecting the most appropriate connection portion 623.

Said centring element 3 can position machine 2 above container "C", while centring machine 2 itself and retaining container "C", thus preventing container "C" from moving, without generating any compression forces on container "C".

Said centring element 3 is able to position itself on container "C", allowing gripping device 6 to engage with lid "L" without acting upon the outer top wall of container "C", and also to retain lid "L".

Said moving devices (5, 64) allow lid "L" to be separated from container "C" and retained, through the use of said gripping elements 62, still without acting upon the outer top wall of container "C".

Said gripping elements 62 act exclusively upon lid "L", without exerting any forces upon and/or abutting against container "C".

Machine 2 according to the present invention avoids applying any forces onto container "C", for the purpose of not causing any damage to container "C" following repeated removals of lid "L" between the different processing stages that the content of the same container "C" must undergo.

In one possible embodiment, machine 2 is positioned on container "C" manually, or in a servoassisted manner, by an operator. It is a task of the operator to appropriately centre machine 2 above container "C". Once positioned, machine 2 is activated by the operator, e.g. through a two-hand control panel, in order to obtain the separation of lid "L" from container "C" and then open the latter.

In a more automated embodiment, the machine can, in a totally automatic manner, position and centre itself on container "C", separate lid "L" from container "C", and hold lid "L" to definitively remove lid "L" from container "C".

REFERENCE NUMERALS

Plant 1
Processing station 12
Moving means 14
Moving device 16
Machine 2
Centring element 3
Abutment portion 32
Support structure 4
First moving device 5
Connection structure 52
Plate 521
Columns 522
First actuator device 54
Gripping device 6
Gripping element 62
Hooking portion (coupled to 63) 622
Coupling portion (acting upon lid) 623
Connection portion (housing) 624
First matching portion (against 644) 625
Second matching portion (against 32) 626
Support element 63
Stop portion 630
Housings 631
Elastic element 632
Second moving device 64
Second actuator device 642
Driving element 644
Container "C"
Lid "L"
Vertical axis "Z"

The invention claimed is:

1. A machine for removal and extraction of a lid for paint and/or dye containers or cans; said machine comprising:

a centering element, adapted to allow properly aligning the machine above the container or can;

a gripping device adapted to selectively act upon at least two points of a lid of the container or can, and capable of both disengaging the lid from the container or can and holding the lid;

a first moving device adapted to move said gripping device along a vertical axis, between at least one first position, proximal to said centering element, and at least one second position, away from said centering element;

a support structure, fixed to said centering element, adapted to support said first moving device;

said gripping device being adapted to take a first operating configuration, wherein it is non-influential upon a protruding portion of the lid, since it does not act upon said protruding portion of the lid; and a second operating configuration, wherein it is adapted to act upon the protruding portion of the lid;

wherein said gripping device comprises:

at least two gripping elements, each one adapted to selectively act upon one protruding portion of the lid;

a support element, to which at least two gripping elements are operationally connected; and a second moving device adapted to move said at least two gripping elements between the first and second operating configurations of the gripping device, wherein said second moving device comprises a second actuator device of the linear type, and a driving element adapted to act upon said gripping elements;

wherein each gripping element comprises:

a coupling portion having a shape complementary to a shape of the protruding portion of the lid, in which said protruding portion of the lid can be at least partly housed; and a first matching portion, whereupon said driving element acts;

said centering element comprising an abutment portion adapted both to abut against an upper edge of an outer top wall of the container or can and to prevent the container or can from moving, without exerting any pressure force upon a remaining portion of said outer top wall of the container or can, in any operating configuration or spatial arrangement of the gripping device; and wherein said gripping element and said second moving device are designed such that a thrust action exerted along said vertical axis on the first matching portion of the gripping element by the second actuator device, through said driving element, is transformed into a substantially straight movement of the coupling portion along an axis perpendicular to said vertical axis.

2. The machine according to claim 1, wherein said first moving device comprises:

a connection structure, to which the gripping device is fixed;

a first actuator device of a linear type, adapted to move said connection structure along said vertical axis.

3. The machine according to claim 1, wherein said support element comprises a plurality of housings, each housing of the plurality of housings housing an elastic element adapted to exert a thrust force against a corresponding gripping element, for bringing said gripping device into the first operating configuration.

4. The machine according to claim 3, wherein each gripping element comprises a hooking portion adapted to connect said gripping element to said support element through the corresponding elastic element, thereby allowing the gripping element to be moved between the first and second operating configurations.

5. A system for dyeing products, said system comprising:

at least one processing station, adapted to process dyeing products contained in a container or can;

at least one moving device for moving one or more containers or cans from and/or to a processing station;

wherein the system comprises a machine according to claim 1.

6. The system according to claim 5, in which at least one moving device is comprised, which is adapted to move said machine, in order to allow the machine to be positioned above the container or can.

7. A machine for removal and extraction of a lid for paint and/or dye containers or cans; said machine comprising:

a centering element, adapted to allow properly aligning the machine above the container or can;

a gripping device adapted to selectively act upon at least two points of a lid of the container or can, and capable of both disengaging the lid from the container or can and holding the lid;

a first moving device adapted to move said gripping device along a vertical axis, between at least one first position, proximal to said centering element, and at least one second position, away from said centering element;

a support structure, fixed to said centering element, adapted to support said first moving device;

said gripping device being adapted to take a first operating configuration, wherein it is non-influential upon a protruding portion of the lid, since it does not act upon said protruding portion of the lid; and a second operating configuration, wherein it is adapted to act upon the protruding portion of the lid;

wherein said gripping device comprises:

at least two gripping elements, each one adapted to selectively act upon one protruding portion of the lid;

a support element, to which at least two gripping elements are operationally connected; and a second moving device adapted to move said at least two gripping elements between the first and second operating configurations of the gripping device, wherein said second moving device comprises a second actuator device of the linear type, and a driving element adapted to act upon said gripping elements;

wherein each gripping element comprises:

a coupling portion having a shape complementary to a shape of the protruding portion of the lid, in which said protruding portion of the lid can be at least partly housed; and a first matching portion, whereupon said driving element acts;

said centering element comprising an abutment portion adapted both to abut against an upper edge of an outer top wall of the container or can and to prevent the container or can from moving, without exerting any pressure force upon a remaining portion of said outer top wall of the container or can, in any operating configuration or spatial arrangement of the gripping device;

wherein said gripping element and said second moving device are designed such that a thrust action exerted along said vertical axis on the first matching portion of the gripping element by the second actuator device, through said driving element, is transformed into a substantially straight movement of the coupling portion along an axis perpendicular to said vertical axis; and wherein the at least two gripping elements comprise a plurality of angularly equidistant gripping elements, which are capable of distributing the action evenly onto the protruding portion of the lid.

8. The machine according to claim 1, wherein said first moving device and said second moving device are completely independent of each other and can be activated autonomously.

* * * * *